US011229262B2

(12) United States Patent
Schuss et al.

(10) Patent No.: US 11,229,262 B2
(45) Date of Patent: Jan. 25, 2022

(54) PROTECTIVE HELMET

(71) Applicant: UVEX ARBEITSSCHUTZ GMBH, Fürth (DE)

(72) Inventors: Frederic Schuss, Nuremberg (DE); Florian Kühnlein, Fürth (DE); Simon Jaschke, Fürth (DE)

(73) Assignee: UVEX ARBEITSSCHUTZ GMBH, Fürth (DE)

( * ) Notice: Subject to any disclaimer, the term of this patent is extended or adjusted under 35 U.S.C. 154(b) by 528 days.

(21) Appl. No.: 16/323,153

(22) PCT Filed: Jul. 20, 2017

(86) PCT No.: PCT/EP2017/068318
§ 371 (c)(1),
(2) Date: Feb. 4, 2019

(87) PCT Pub. No.: WO2018/024493
PCT Pub. Date: Feb. 8, 2018

(65) Prior Publication Data

US 2019/0166957 A1 Jun. 6, 2019

(30) Foreign Application Priority Data

Aug. 5, 2016 (DE) ..... 10 2016 214 526.6

(51) Int. Cl.
*A44B 11/25* (2006.01)
*A44B 11/26* (2006.01)
*A42B 3/08* (2006.01)

(52) U.S. Cl.
CPC ..... *A44B 11/2569* (2013.01); *A42B 3/08* (2013.01); *A44B 11/266* (2013.01)

(58) Field of Classification Search
CPC ..... A42B 3/08; A44B 11/266
See application file for complete search history.

(56) References Cited

U.S. PATENT DOCUMENTS 6,615,460 B1 9/2003 Baumgarten

FOREIGN PATENT DOCUMENTS

| | | |
|---|---|---|
| EP | 3 165 108 A1 | 5/2017 |
| GB | 2 531 146 A | 4/2016 |
| WO | 2005/058086 A1 | 6/2005 |

*Primary Examiner* — Richale L Quinn
(74) *Attorney, Agent, or Firm* — McGlew and Tuttle, P.C.

(57) ABSTRACT

A protective helmet including a helmet shell for at least partially covering the head of a helmet wearer, and a holding strap arrangement arranged on the helmet shell for holding the helmet shell on the head of the helmet wearer. The holding strap arrangement includes a chin strap connected to the helmet shell, a first closure part connected to the helmet shell, and a second closure part connected to the chin strap and can be brought into closed connection with the first closure part, with a closure being formed. The closure automatically opens in a first closed position if a predetermined opening tensile force acts between the closure parts, and the closure parts separate from each other. In a second closed position, the first closure part and the second closure part are always in closed connection with each other irrespective of a tensile force acting between the closure parts.

13 Claims, 7 Drawing Sheets

PROTECTIVE HELMET

CROSS REFERENCE TO RELATED APPLICATIONS

This application is a United States National Phase Application of International Application PCT/EP2017/068318 filed Jul. 20, 2017 and claims the benefit of priority under 35 U.S.C. § 119 of German Patent Application, Serial No. 10 2016 214 526.6, filed Aug. 5, 2016, the entire contents of which are incorporated herein by reference.

FIELD OF THE INVENTION

The invention relates to a protective helmet. The protective helmet is preferably used in the occupational safety sphere. However, the protective helmet can alternatively also be used in the sports sphere and is then advantageously adapted depending on the use to the respective type of sport.

BACKGROUND OF THE INVENTION

A very wide variety of protective helmets are already known from the prior art.

Firstly, there are protective helmets which, for protection reasons, always have to sit securely on the head of the helmet wearer. At the same time, however, the risk of strangulation of the helmet wearer by the protective helmet has to be permanently excluded. In order to avoid strangulation, the relevant standards therefore prescribe automatic release and opening of the chin strap of the protective helmet, said chin strap being able to be part of a holding strap arrangement of the protective helmet. Such helmets are frequently worn on building sites.

Secondly, however, the prior art also discloses protective helmets with holding strap arrangements, the chin straps of which must never automatically open during wearing for protection reasons. It is thus prevented that the helmet wearer losses the protective helmet in a hazardous situation and therefore is unprotected in the head region. Such protective helmets are generally worn during climbing and cycling.

WO 2005/058086 A1 discloses a strap release device. U.S. Pat. No. 6,615,460 B1 discloses a closure for straps.

GB 2 531 146 A discloses a safety helmet with a chin strap. The chin strap can be configured between a weak configuration where the chin strap is released at a force below a predetermined threshold value, and a strong configuration where the chin strap is released at a force above a predetermined threshold value.

EP 3 165 108 A1, which was subsequently published, discloses a chin strap closure with a connecting part which is connected mechanically to a first closure part and a second closure part. Furthermore, there is a movable part which is movable between a first and a second position.

SUMMARY OF THE INVENTION

The invention is based on an object of providing a protective helmet which has an extremely wide range of use and always provides particularly good protection. The protective helmet is intended in particular to be able to be easily and optimally adapted to the respective use.

This object is achieved according to the invention by a protective helmet, a) comprising a helmet shell for at least partially covering the head of a helmet wearer, and b) comprising a holding strap arrangement which is arranged on the helmet shell for holding the helmet shell on the head of the helmet wearer, wherein the holding strap arrangement comprises I) a chin strap which is connected to the helmet shell, ii) a first closure part which is connected to the helmet shell, and iii) a second closure part which is connected to the chin strap and can be brought into closed connection with the first closure part, with a closure being formed, iv) wherein the closure automatically opens in its first closed position in the event of a predetermined opening tensile force acting between the closure parts, and the closure parts separate from each other, v) wherein, in a second closed position of the closure, the first closure part and the second closure part are always in closed connection with each other irrespective of a tensile force acting between the closure parts, vi) wherein, in order to form the respective closed position, the first or second closure part comprises a pivotable pivoting component, vii) wherein the pivoting component is mounted pivotably on a basic body of the closure part comprising the pivoting component, viii) wherein at least one tongue retaining receptacle is formed in the closure part comprising the pivotable pivoting component, and the other closure part has a tongue arrangement for engaging in the at least one tongue retaining receptacle, ix) wherein, in the first closed position, the pivoting component has a first introduction direction and a first removal direction oriented in an opposed manner with respect thereto, wherein, in order to form the first closed position, the tongue arrangement is introduceable in direction of the first introduction direction into the second closure part comprising the pivoting component, and, in order to release the first closed position, the tongue arrangement is pullable in direction of the first removal direction out of the second closure part comprising the pivoting component, wherein the at least one tongue retaining receptacle is bounded by a first retaining flank which interacts in a retaining manner with the tongue arrangement in the first closed position, and has an inclination in relation to a perpendicular to the first introduction direction and, with respect to the perpendicular to the first introduction direction, is inclined toward the first removal direction, as seen from laterally outside toward inside.

The essence of the invention consists in that the holding strap arrangement behaves differently to a tensile force acting on the closure parts of the closure depending a selected closed position of the closure. The holding strap arrangement, in particular the chin strap, can be closed or opened by means of the closure.

When the protective helmet is worn as intended and the closure is closed, the protective helmet is held securely on the head of the helmet wearer and the latter's head is thus protected.

The closed positions can in particular be selected or set by the helmet wearer. In a first closed position of the closure, the closure automatically opens in the event of a corresponding opening tensile force being present between the closure parts. In the second closed position of the closure, there is no comparable automatic opening. On the contrary, in the second closed position of the closure, the protective helmet is always held on the head of the helmet wearer. The protective helmet thus meets the relevant standard depending on the selected closed position.

There is a form fitting connection between the closure parts in the closed positions. A latching connection is advantageously present here.

The first retaining flank runs in such a manner that, when the opening tensile force is present, the first retaining flank transfers the tongue arrangement or the at least one tongue arm into its opening position.

In particular, in both closed positions, the pivoting component in each case has an introduction direction and a removal direction oriented in an opposed manner with respect thereto. In order to form the respective closed position, the tongue arrangement is introduced in the direction of the relevant introduction direction into the closure part comprising the pivoting component or into the pivoting component. Furthermore, in order to release or open the respective closed position, the tongue arrangement is pulled in the direction of the relevant removal direction out of the closure part comprising the pivoting component or out of the pivoting component.

The expression "are always in closed connection" refers here in particular to tensile forces which can occur at the closure during normal use of the protective helmet or in the event of anticipated hazardous situations. In particular, tensile forces which generally do not occur during normal use of the protective helmet or in the event of anticipated hazardous situations and/or lead to destruction of the closure are prevented.

In addition, the closure in the two closed positions can in particular also be opened manually, such as by an actuation of a release mechanism to be undertaken in a targeted manner by the helmet wearer or another person.

The pivoting component is advantageously designed in the manner of a plate and in particular is dimensionally stable. It is of advantage if the pivoting component is symmetrical with respect to at least one main plane, in particular central plane.

After opening of the closure, the protective helmet is no longer held on the head of the helmet wearer. It is thus as it were released or unfixed.

Advantageously, in order to form the respective closed position, the first and/or second closure part can be correspondingly shifted, in particular can be pivoted, in its entirety or partially, in particular in relation to the other closure part.

The helmet shell is advantageously rigid and preferably bounds a head receiving space. It is of advantage if the helmet shell comprises a shock absorbing material. A soft lining is preferably provided in the helmet shell.

It is expedient if the chin strap is indirectly connected to the helmet shell. For example, the chin strap is connected to the helmet shell via at least one connection part, such as a connection strap, a connection plate or the like. Alternatively, the chin strap is connected directly to the helmet shell. Combinations are possible. The chin strap is advantageously flexible or pliant.

The chin strap can be connected directly or indirectly to the closure or to a closure part. The closure or the other closure part can be connected directly or indirectly to the helmet shell.

The opening tensile force at which the closure opens is greater than 130 N, preferably greater than 150 N, firstly prevents the closure from already being undesirably opened in the event of (very) small opening tensile forces, which would then lead to the helmet wearer being put at risk.

The opening tensile force at which the closure opens is smaller than 280 N, preferably smaller than 250 N, ensures that the closure is opened promptly and the helmet wearer is not injured by the closure opening too late or not at all.

The refinement, in which the pivotable pivoting component has a first pivoting position and a second pivoting position corresponding to the two closed positions of the closure, wherein the pivoting component is in each case locked in said two pivoting positions, leads to an extremely secure protective helmet. An undesirable pivoting if the pivoting component is thus suppressed. The pivoting component is advantageously secured in the closure in a form fitting manner, in particular in the manner of a bolt, in its respective pivoting position, in particular in its two pivoting positions. The pivoting component can advantageously be released again by application of a corresponding opening force, in particular opening compressive force.

The at least one resiliently designed tongue arm advantageously springs into its retaining position when a closed position of the closure is reached. In particular, the at least one tongue arm is deflected, in particular laterally inward, counter to a spring force upon introduction into the pivoting component or when said tongue arm is guided in the pivoting component.

For this purpose, the at least one tongue arm advantageously bears an introduction slope or ramp for deflecting same laterally inward upon introduction into the pivoting component or when it is guided in the pivoting component.

The at least one retaining projection for holding the tongue arm in the at least one tongue retaining receptacle advantageously projects laterally outward. It is of advantage if the at least one tongue arm can be deflected manually from its retaining position into an inner release position in order to open the closure again.

The at least one retaining projection advantageously has a retaining surface which, at least in regions, runs perpendicularly or obliquely with respect to the relevant introduction direction.

With a first retaining angle which is between 60° and 80° with the first introduction direction dimensioned, in particular standard, automatic opening of the closure in the event of the presence of a corresponding opening force can be achieved in a simple and advantageous manner.

The second retaining flank which interacts in a retaining manner with the tongue arrangement in the second closed position, and is designed in such a manner that automatic opening of the second closed position is always prevented, preferably runs in an opposite manner to the first retaining flank. Said retaining flanks preferably extend obliquely or anti parallel to each other. The second retaining flank runs in such a manner that, when a tensile force is present between the closure parts, the second retaining flank keeps the tongue arrangement in its closed position or the at least one tongue arm remains undeflected, and preferably no automatic opening of the closure in its second closed position occurs.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
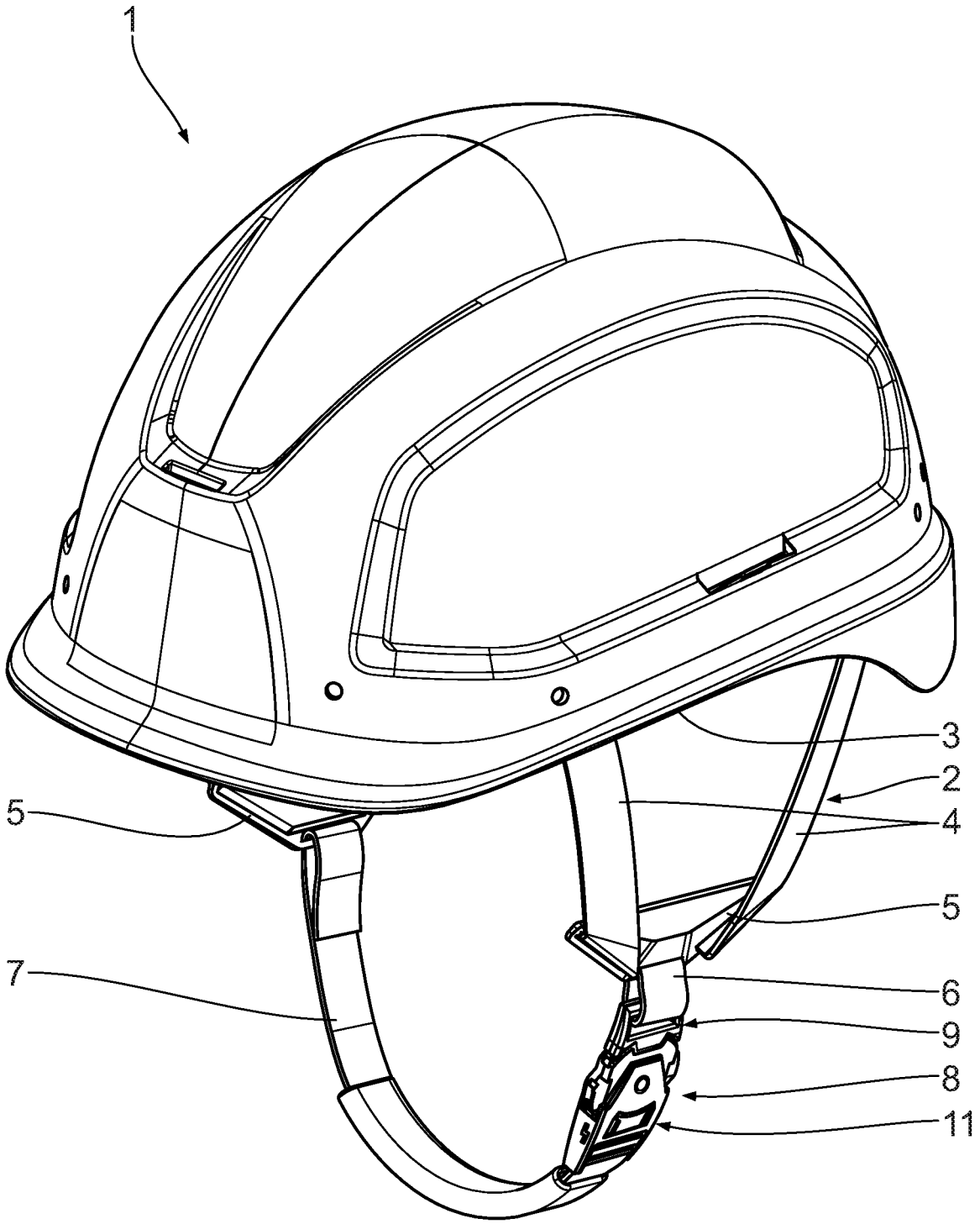
FIG. 1 is a view of a protective helmet according to the invention in its entirety with a closed holding strap arrangement.

With reference first of all to FIG. 1, a protective helmet illustrated in its entirety there comprises a bowl like helmet shell 1 and a holding strap arrangement 2 which is arranged on the helmet shell 1 for securing the helmet shell 1 on the head of a helmet wearer (not illustrated).

The helmet shell 1 is rigid and preferably formed from a plastics material. The helmet shell 1 is advantageously formed symmetrically with respect to a plane of symmetry. It bounds a head receiving space. When the helmet shell 1 is borne as intended, the helmet shell 1 sits on the head of the helmet wearer and covers said head at the top and laterally.

On each longitudinal side edge 3 of the helmet shell 1, at least one connection strap 4 is connected to the helmet shell 1, said connection strap bearing a coupling part 5 preferably at a distance from the helmet shell 1 and being part of the holding strap arrangement 2. In addition, the holding strap arrangement 2 comprises a connecting strap 6 which is directly connected to one of the coupling parts 5. A chin strap 7 of the holding strap arrangement 2 is connected to the other coupling part 5.

A closure 8 (also see FIGS. 2 to 12) is arranged between the connecting strap 6 and the chin strap 7, said closure, in its closed position, connecting the chin strap 7 fixedly to the connecting strap 6 and, in its release position, releasing the chin strap 7 there.

The closure 8 comprises a first closure part 9 which is connected to the connecting strap 6 and, for this purpose, has a connecting strap connection part 10. Furthermore, the closure 8 has a second closure part 11 which is connected to the chin strap 7 and, to this end, has a chin strap connection part 12.

The first closure part 9 and the second closure part 11 can be connected to each other in order to form the closure 8. For this purpose, the first closure part 9 has a tongue arrangement 13 while the second closure part 11 has or bounds two identical introduction receptacles 14 and two identical tongue retaining receptacles 15.

The first closure part 9 is formed symmetrically with respect to a first plane of symmetry E1. It has two tongue arms 16 which project from the connecting strap connection part 10 and run substantially parallel to each other and to the plane of symmetry E1 (see in particular FIG. 5).

Each tongue arm 16 bears, adjacent to its free end 20, a retaining projection 17 which springs away laterally outward or from the first plane of symmetry E1, with a retaining surface 18 facing the connecting strap connection part 10 being formed. The retaining surfaces 18 run at least in regions obliquely with respect to the first plane of symmetry E1. They extend from laterally on the outside obliquely inward in the direction of the connecting strap connection part 10. The retaining surfaces 18 therefore converge toward each other from laterally on the outside in the direction of the connecting strap connection part 10. Alternatively, the retaining surfaces 18 extend perpendicularly to the first plane of symmetry E1.

In addition, each tongue arm 16 has an introduction ramp 19 which faces away from the connecting strap connection part 10 and is arranged adjacent to the free end 20 of the respective tongue arm 16. The introduction ramps 19 extend from the free end 20 to laterally on the outside in the direction of the connecting strap connection part 10.

Two plug in pins 21 project from the connecting strap connection part 10 between the two tongue arms 16. The two plug in pins 21 extend parallel to each other and to the first plane of symmetry E1. They are formed separately and run at a distance to the tongue arms 16. The tongue arms 16 can be deflected resiliently or toward each other at a distance from the connecting strap connection part 10 in the direction of the plug in pins 21 or the first plane of symmetry E1.

Figure 5:
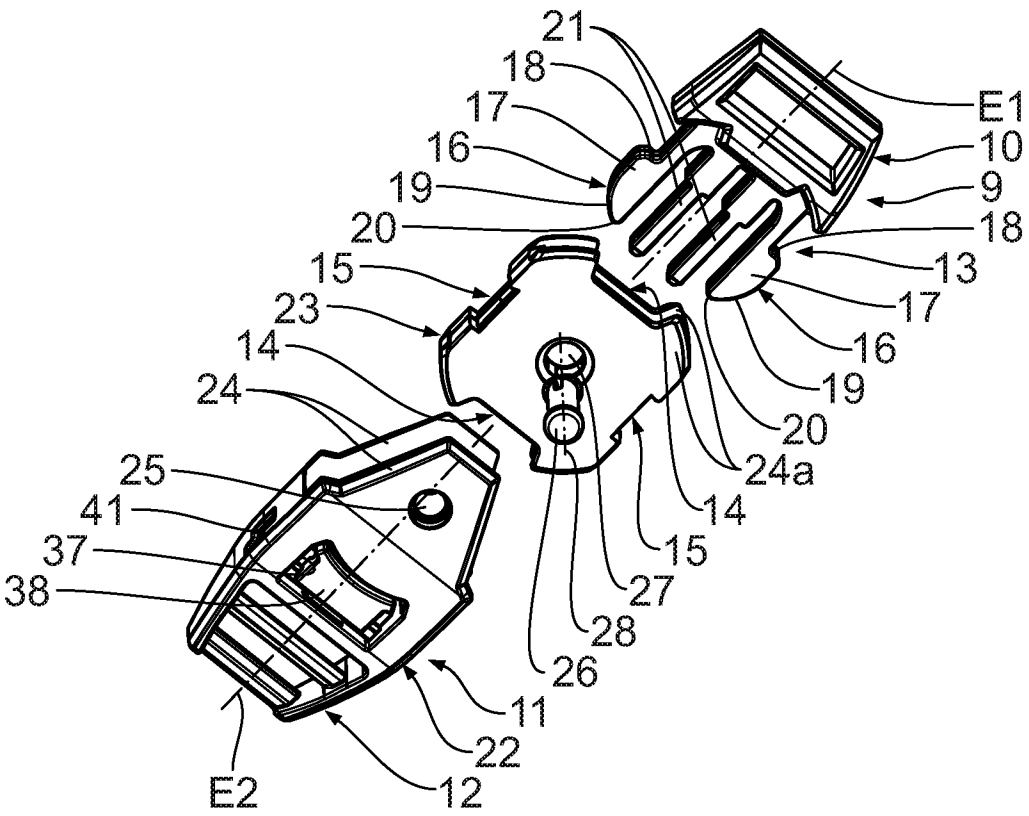
FIG. 5 is an exploded view of the closure shown in FIGS. 2 and 3.

The second closure part 11 has a basic body 22 and a pivoting component 23 which is mounted pivotably on the basic body 22 (see in particular FIG. 5).

The basic body 22 is formed symmetrically with respect to a second plane of symmetry E2. It bears the chin strap connection part 12 and comprises two bearing plates 24 which run parallel to each other and in which a cylindrical bearing opening 25 is in each case formed. The bearing openings 25 are aligned with each other.

The pivoting component 23 is partially embraced by the bearing plates 24. A substantially cylindrical bearing journal 26 passes through the two bearing openings 25 and the pivoting component 23 which, for this purpose, has a centrally arranged, continuous, cylindrical bearing recess 27 (also see FIG. 6). The pivoting component 23 is pivotable in relation to the basic body 22 about the bearing journal 26, which predetermines a pivot axis 28, when the pivoting component 23 is released for pivoting about the pivot axis 28. This will be explained in more detail below. The second plane of symmetry E2 runs perpendicularly to the bearing plates 24 and encloses the pivot axis 28.

The pivoting component 23 is formed symmetrically with respect to a third plane of symmetry E3 and a fourth plane of symmetry E4 which run perpendicularly to each other and intersect in the pivot axis 28. The third plane of symmetry E3 and the fourth plane of symmetry E4 each enclose the pivot axis 28.

The pivoting component 23 has a substantially square or rectangular basic shape, the corners of which are beveled or rounded. It has the two introduction receptacles 14 and the two tongue retaining receptacles 15 on the edge side or laterally. The two introduction receptacles 14 are arranged lying opposite each other and have introduction openings 14*a*. The two tongue retaining receptacles 15 also lie opposite each other. The two introduction openings 14*a* and the two tongue retaining receptacles 15 are in each case arranged on different side edges of the square or rectangular basic shape of the pivoting component 23. The basic body 22 is open laterally outward in the tongue retaining receptacles 15. The introduction openings 14*a* and a tongue arrangement receptacle for receiving the tongue arrangement 13 are in particular bounded at the top and bottom by two cover plates 24*a*. The two cover plates 24*a* are part of the pivoting component 23.

Adjacent to each introduction receptacle 14, the pivoting component 23 has two flanks 29 on each cover plate 24*a*. The flanks 29 arranged adjacent to the respective introduction receptacle 14 run obliquely toward each other from an outer circumferential edge 30 of the pivoting component 23 in the direction of the pivot axis 28 and are connected to each other via a base 31 of the respective cover plate 24*a*. The bases 31 run parallel to each other. Receptacles 42 which taper inward are formed by the flanks 29 arranged in pairs and by the adjacent base 31.

The first closure part 9 bears at least one locking body 32 which in each case has two locking surfaces 33 running away from the connecting strap connection body 10 in the direction of the free ends 20 and converging. The at least one locking body 32 is adapted to the receptacles 42.

Each tongue retaining receptacle 15 has, on the edge side or laterally, a first retaining flank 34 and a second retaining flank 35 lying opposite the first retaining flank 34. The retaining flanks 34, 35 extend between the two cover plates 24*a* and close the pivoting component 23 there. The retaining flanks 34, 35 extend from the outside in the direction of the third plane of symmetry E3.

Between the first retaining flank 34 and the second retaining flank 35, a bottom 36 extends from each tongue retaining receptacle 15. The bottoms 36 run rectilinearly and parallel to each other. In addition, they extend parallel to the third plane of symmetry E3 or perpendicularly to the fourth plane of symmetry E4. In the region of the bottoms 36, the pivoting component 23 is open laterally outward.

Each first retaining flank 34 encloses a first angle w1, which is between 60° and 80°, with the adjacent bottom 36 or the third plane of symmetry E3. The first retaining flanks 34 run from laterally on the outside obliquely inward in the direction of the adjacent introduction receptacle 14.

The second retaining flanks 35 run substantially parallel to the fourth plane of symmetry E4 or substantially perpendicularly to the third plane of symmetry E3. Each second retaining flank 35 encloses a second angle w2, which is approximately 90°, with the adjacent bottom 36 or the third plane of symmetry E3.

Each tongue retaining receptacle 15 therefore expands from laterally on the outside inward in the direction of the third plane of symmetry E3, which can be attributed to the oblique profile of the first retaining flanks 34. Each tongue retaining receptacle 15 is bounded by the first and second retaining flanks 34, 35.

Furthermore, in one of its bearing plates 24, the second closure part 11 has a window 37 which is bounded circumferentially and in which a locking element 38 is located. The locking element 38 is deflectably connected to a carrier 39 of the second closure part 11.

Figure 8:
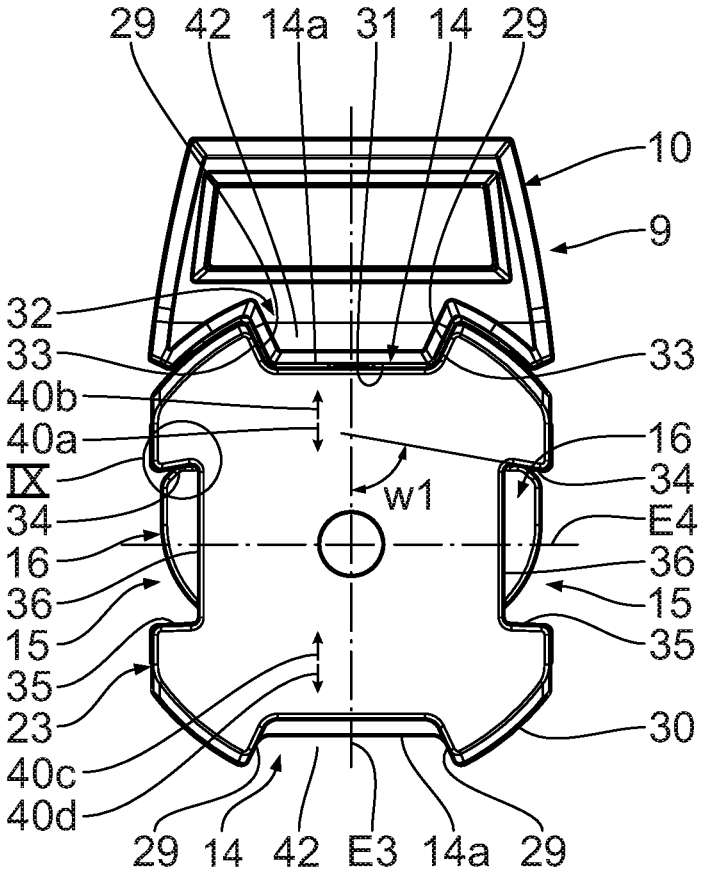
FIG. 8 is a view of the closure which is illustrated in FIGS. 2 to 7 and is in a first closed position.

In the first closed position, the pivoting component 23 has a first introduction direction 40*a* and a first removal direction 40*b* oriented in an opposed manner with respect thereto (FIG. 8).

In the second closed position, the pivoting component 23 has a second introduction direction 40*c* and a second removal direction 40*d* oriented in an opposed manner with respect thereto (FIG. 8). The first and second introduction directions 40*a*, 40*c* are oriented in an opposed manner. The first and second removal directions 40*b*, 40*d* are oriented in an opposed manner.

The holding strap arrangement 2 will be described in more detail below during use.

When the closure 8 is in its open position and the closure parts 9, 11 are separated from each other, the helmet shell 1 can be placed onto the head of a helmet wearer and the chin strap 7 guided around the chin of the helmet wearer in order to locally fix the helmet shell 1 on the head of the helmet wearer.

In the closed position of the closure 8, the closure parts 9, 11 are connected fixedly, but releasably again, to each other and the chin strap 7 runs around the chin of the helmet wearer, and therefore the helmet shell 1 is held on the head of the helmet wearer. The connecting strap connection part 10 and the chin strap connection part 12 are then arranged at mutually averted ends of the closure 8.

The closure 8 has two different closed positions which are present in different pivoting positions of the pivoting component 23 in relation to the basic body 22 or the tongue arrangement 13. In order to bring the closure 8 into a closed positions, the plug in pins 21 and the tongue arms 16 with the retaining projections 17 are introduced in an introduction direction via an introduction opening 14*a* into an introduction receptacle 14, wherein the two tongue arms 16 together with retaining projections 17 are deflected resiliently toward each other via their leading introduction ramps 19 at the flanks 29 or into their open position in the direction of the first plane of symmetry E1. As soon as the retaining projections 17 reach the tongue retaining receptacles 15, the tongue arms 16 spring back into their original, undeflected (closed) position and engage in a locking manner with their retaining projections 17 in the tongue retaining receptacles 15, as a result of which the first closure part 9 and the second closure part 12 are coupled to each other.

In the closed positions of the closure 8, the pivoting component 23 is in each case non rotatable in relation to the first closure part 9 and the basic body 22.

Figure 2:
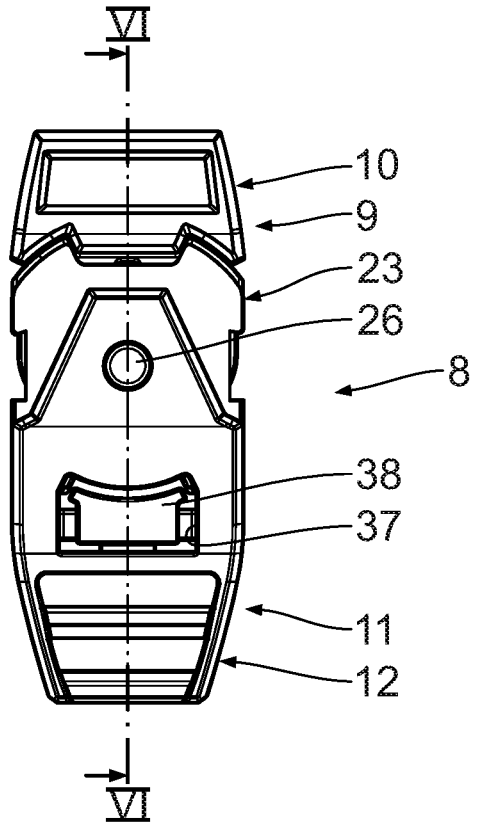
FIG. 2 is a view of the closure of the helmet shown in FIG. 1.
Figure 3:
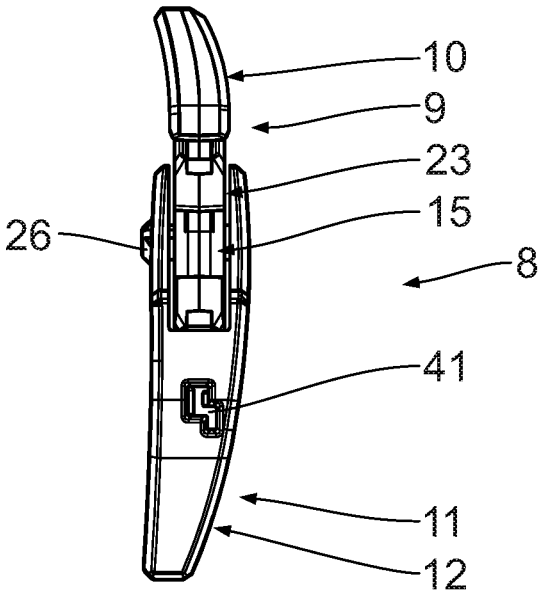
FIG. 3 is a side view of the closure illustrated in FIG. 2.
Figure 9:
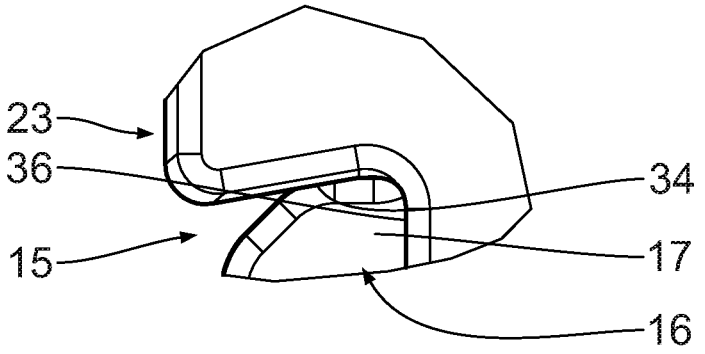
FIG. 9 is a view of the detail IX indicated in FIG. 8.

If the pivoting component 23 is in its first pivoting position or closed position shown in FIGS. 8 and 9, the first retaining flanks 34 are arranged closer than the second retaining flanks 35 to the first closure part 9 (also see FIGS. 2, 3). To this end, the tongue arrangement 13 has been introduced via the first introduction opening 14*a* in the first introduction direction 40*a* into the pivoting component 23. When the closure 8 is correspondingly closed, the retaining surfaces 18 are arranged facing the first retaining flanks 34 or adjacent thereto. The first retaining flanks 34 provide resistance to the first closure part 9 being pulled out of the second closure part 11 or the pivoting component 23 in the first removal direction 40*b*.

If an opening tensile force of between 130 N and 280 N, preferably be-tween 150 N and 250 N, acts between the two closure parts 9, 11, the retaining surfaces 18 slide along the first retaining flanks 34 in the direction of the third plane of symmetry E3, wherein the tongue arms 16 are moved toward each other into their open position and are disengaged from the tongue retaining receptacles 15. For this purpose, the first retaining flanks 34 are inclined laterally from the outside in the first removal direction 40*b*.

Figure 10:
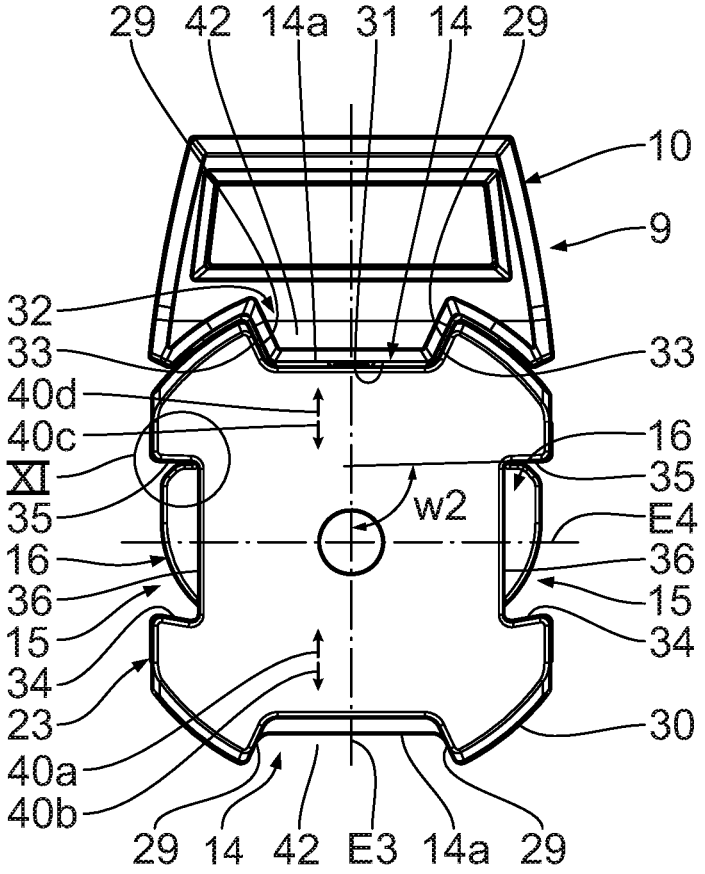
FIG. 10 is a top view corresponding to FIG. 8, wherein the closure is in its second closed position.
Figure 11:
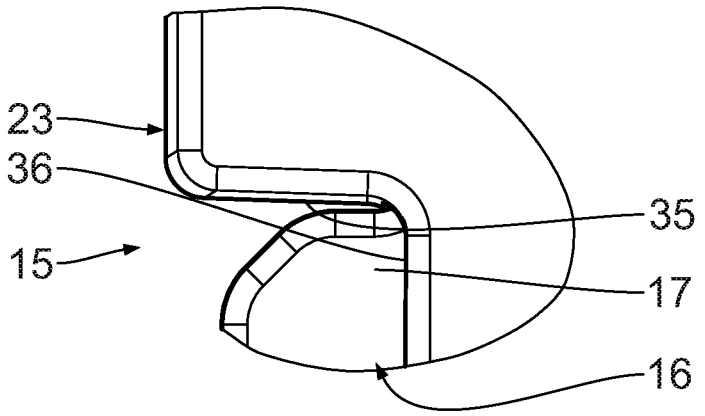
FIG. 11 is a view of the detail XI indicated in FIG. 10.

If, by contrast, the pivoting component 23 is in its second pivoting position or closed position that is shown in FIGS. 10, 11, the second retaining flanks 35 are arranged closer than the first retaining flanks 34 to the first closure part 9. To this end, the tongue arrangement 13 has been introduced via the other introduction opening 14*a* in the second introduction direction 40*c* into the pivoting component 23. When the closure 8 is correspondingly closed, the retaining surfaces 18 are arranged facing the second retaining flanks 35 or adjacent thereto. On account of the absence of an oblique position of the second retaining flanks 35 in the second removal direction 40*d*, a tensile force acting between the closure parts 9, 11 does not lead to a deflection of the tongue arms 16 and therefore does not lead to automatic opening of the closure 8.

The two closed positions differ from each other by an angle of 180° about the pivot axis 28 by rotation of the pivoting component 23.

In each closed position, the locking body 32 engages in a form fitting manner in the corresponding receptacle 42. Furthermore, the plug in pins 21 and the tongue arms 16 engage in the tongue arrangement receptacle of the pivoting component 23. The pivoting component 23 is then non rotatable in relation to the first closure part 9.

As mentioned, the pivoting component 23 is locked in its two pivoting positions in relation to the basic body 22. The locking element 38 acts here in a locking manner or in the manner of a bolt on the pivoting component 23, in particular on at least one cover plate 24*a* (see in particular FIGS. 6, 7).

Figure 4:
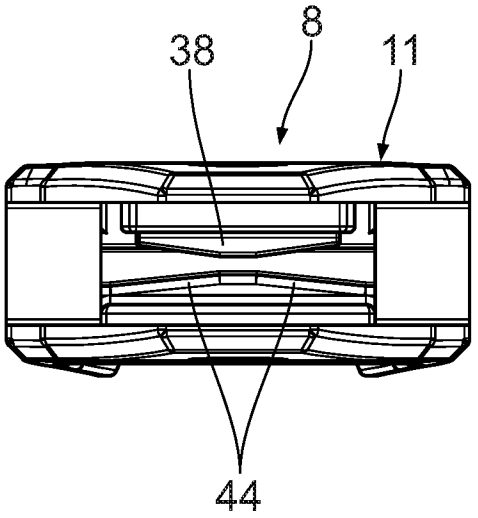
FIG. 4 is a side view of the pivoting component of the closure illustrated in FIGS. 2 and 3.
Figure 6:
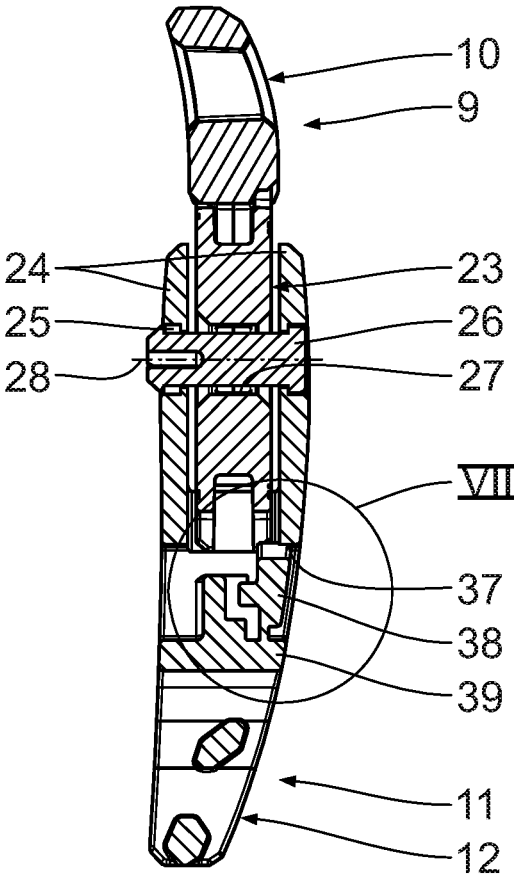
FIG. 6 is a sectional view of the closure along the intersecting line VII-VII illustrated in FIG. 2.
Figure 7:
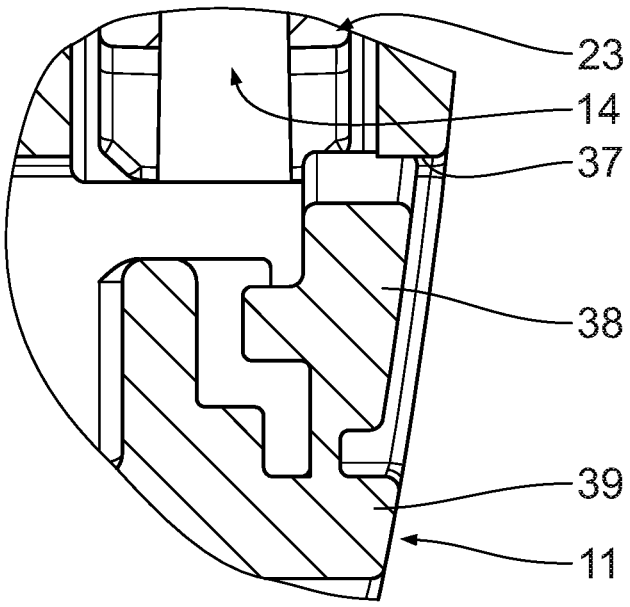
FIG. 7 is a view of the detail VI, which is indicated in FIG. 6, of the closure.
Figure 12:
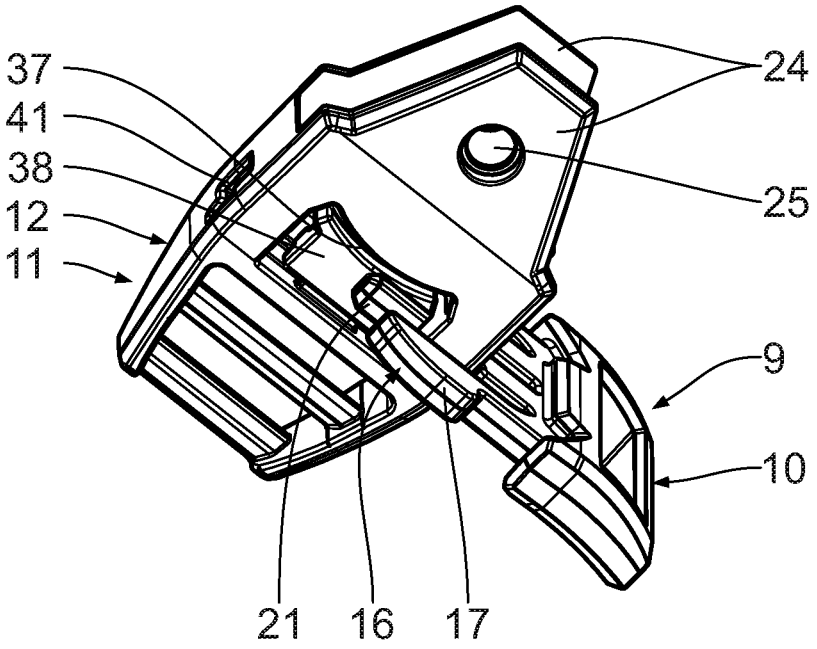
FIG. 12 is a view which shows the release of the pivoting component from its pivoting position.

In order to pivot the pivoting component 23 in relation to the basic body 22, the locking element 38 has to be pressed outward so that the locking element 38 no longer acts on the pivoting component 23 in a locking manner and a pivoting movement of the pivoting component 23 about the pivot axis 28 in relation to the basic body 22 is possible. For this purpose, the tongue arrangement 13 is advantageously plugged laterally from the outside over release openings 41 present in the side walls of the basic body 22. The plug in pin 21 adjacent to the window 37 here pushes the resiliently held locking element 38 out of the window 37 and away from the pivoting component 23. The plug in pin 21 is guided here via one of the two corresponding ramps 44 arranged for this purpose within the basic body 22 (FIGS. 4, 12). After the plug in pin 21 is removed, the locking element 38 springs back into its locking position.

A reverse arrangement of the closure parts 9, 11 is alternatively possible. The closure 8 then comprises a first closure part which is connected fixedly to the chin strap in the mounted state and, for this purpose, has a chin strap connection part. Furthermore, the closure then has a second closure part which is directly connected to the connecting belt and, for this purpose, has a connecting belt connection part.

While specific embodiments of the invention have been shown and described in detail to illustrate the application of the principles of the invention, it will be understood that the invention may be embodied otherwise without departing from such principles.

The invention claimed is:

1. A protective helmet, comprising:

a helmet shell for at least partially covering a head of a helmet wearer;

a holding strap arrangement arranged on the helmet shell for holding the helmet shell on the head of the helmet wearer, wherein the holding strap arrangement comprises a chin strap, a first closure part and a second closure part, the chin strap being connected to the helmet shell, the first closure part being connected to the helmet shell, the second closure part being connected to the chin strap and the second closure being configured to be brought into closed connection with the first closure part, with a closure being formed, wherein the closure automatically opens in a first closed position in event of a predetermined opening tensile force acting between the first closure part and the second closure part, and the first closure part and the second closure part being separate from each other, wherein, in a second closed position of the closure, the first closure part and the second closure part are always in closed connection with each other irrespective of a tensile force acting between the first closure part and the second closure part, wherein, in order to form a respective closed position, one of the first closure part and the second closure part comprises a pivotable pivoting component, the pivoting component being mounted pivotably on a basic body of the one of the first closure part and the second closure part comprising the pivotable pivoting component, wherein at least one tongue retaining receptacle is formed in the one of the first closure part and the second closure part comprising the pivotable pivoting component, and another one of the first closure part and the second closure part has a tongue arrangement for engaging in the at least one tongue retaining receptacle, wherein, in the first closed position, the pivoting component has a first introduction direction and a first removal direction oriented in an opposed manner with respect thereto, wherein, in order to form the first closed position, the tongue arrangement is configured to be inserted in a direction of the first introduction direction into the one of the first closure part and the second closure part comprising the pivoting component, and, in order to release the first closed position, the tongue arrangement is configured to be moved in a direction of the first removal direction out of the one of the first closure part and the second closure part comprising the pivoting component, wherein the at least one tongue retaining receptacle is bounded by a first retaining flank, the first retaining flank interacting in a retaining manner with the tongue arrangement in the first closed position, the first retaining flank having an inclination in relation to a perpendicular to the first introduction direction and, with respect to the perpendicular to the first introduction direction, the first retaining flank is inclined toward the first removal direction, as seen from laterally outside toward inside.

2. The protective helmet as claimed in claim 1, wherein the opening tensile force at which the closure opens is greater than 130 N.

3. The protective helmet as claimed in claim 1, wherein the opening tensile force at which the closure opens is less than 280 N.

4. The protective helmet as claimed in claim 1, wherein the pivotable pivoting component has a first pivoting position and a second pivoting position corresponding to the first closure position and the second closure position of the closure, wherein the pivoting component is in each case locked in the first pivoting position and the second pivoting position.

5. The protective helmet as claimed in claim 1, wherein the tongue arrangement has at least one resilient tongue arm.

6. The protective helmet as claimed in claim 5, wherein the at least one resilient tongue arm has at least one retaining projection for holding the at least one resilient tongue arm in the at least one tongue retaining receptacle.

7. The protective helmet as claimed in claim 1, wherein the first retaining flank encloses a first retaining angle which is between 60° and 80° with the first introduction direction.

8. The protective helmet as claimed in claim 1, wherein, in the second closed position, the pivoting component has a second introduction direction and a second removal direction oriented in an opposed manner with respect thereto, wherein, in order to form the second closed position, the tongue arrangement is introduced in a direction of the second introduction direction into the second closure part comprising the pivoting component, and, in order to release the second closed position, the tongue arrangement is configured to be moved in a direction of the second removal direction out of the one of the first closure part and the second closure part comprising the pivoting component, wherein the at least one tongue retaining receptacle is bounded by a second retaining flank, the second retaining flank interacting in a retaining manner with the tongue arrangement in the second closed position, the second retaining flank being configured such that automatic opening of the second closed position is always prevented.

9. The protective helmet as claimed in claim 8, wherein the second retaining flank encloses a second retaining angle which is at least 80° with the second introduction direction.

10. The protective helmet as claimed in claim 8, wherein the inclination of the first retaining flank in relation to the first introduction direction and an inclination of the second retaining flank in relation to the second introduction direction differ from each other.

11. The protective helmet as claimed in claim 10, wherein the second retaining angle is greater than the first retaining angle.

12. The protective helmet as claimed in claim 2, wherein the opening tensile force at which the closure opens is greater than 150 N.

13. The protective helmet as claimed in claim 1, wherein the opening tensile force at which the closure opens is less than 250 N.

* * * * *